US005411423A

United States Patent [19]

Higby

[11] Patent Number: 5,411,423

[45] Date of Patent: May 2, 1995

[54] MARINE PROPULSION DEVICE WITH RELEASABLY COUPLED DRIVE SHAFT ASSEMBLY

[76] Inventor: Jeffrey P. Higby, 17604 W. Summit Dr., Wildwood, Ill. 60030

[21] Appl. No.: 118,413

[22] Filed: Sep. 8, 1993

[51] Int. Cl.[6] ..... B63H 23/34

[52] U.S. Cl. ..... 440/83; 403/326; 74/323; 464/158

[58] Field of Search ..... 440/75, 83; 74/323; 464/158; 403/315-319, 321, 324, 326, 327, 359

[56] References Cited

U.S. PATENT DOCUMENTS

| | | | |
|---|---|---|---|
| 4,493,662 | 1/1985 | Taguchi | 440/83 |
| 4,832,637 | 5/1989 | Goluba | 440/83 |
| 4,869,121 | 9/1989 | Meisenburg | 74/323 |
| 5,112,259 | 5/1992 | McElroy, Jr. et al. | 440/83 |

FOREIGN PATENT DOCUMENTS

| | | | |
|---|---|---|---|
| 644171 | 10/1950 | United Kingdom | 403/328 |

*Primary Examiner*—Jesus D. Sotelo

[57] ABSTRACT

Disclosed herein is a shaft assembly including a vertically extending axis and comprising a lower shaft having an upper end portion including an upper end, and an axial bore extending downwardly from the upper end, an upper shaft including a lower end portion received in the axial bore and including a lower end and an outer surface extending axially from the lower end, means on the outer end portions of the upper and lower shafts for preventing rotary movement therebetween, and means for selectively permitting assembly and disassembly of the upper and lower shafts and for preventing disassembly of the upper and lower shafts comprising an annular groove in the axial bore in the lower shaft, an inclined bore located in the end portion of the upper shaft, extending upwardly at an acute angle to the axis, and having an opening located wholly in the outer surface, and a ball movable in the inclined bore and in the annular groove between a locked position wherein, when the axis is vertical, the ball is partially located in the annular groove and partially located in the inclined bore, thereby preventing disassembly of the shafts, and an unlocked position wherein the ball is wholly located in the inclined bore, thereby permitting assembly and disassembly of the shafts by permitting insertion and withdrawal of the end portion of the upper shaft relative to the axial bore of the lower shaft.

3 Claims, 1 Drawing Sheet

MARINE PROPULSION DEVICE WITH RELEASABLY COUPLED DRIVE SHAFT ASSEMBLY

BACKGROUND OF THE INVENTION

The invention relates generally to marine propulsion devices such as outboard motors and stern drive units, including two-part drive shaft assemblies.

The invention also relates to arrangements releasably for coupling or connecting two shafts to form a shaft assembly.

In the past, two-piece drive shaft assemblies, i.e., drive shaft assemblies including upper and lower shafts, have been employed in outboard motors, which drive shaft assemblies were connected by pinning together the upper and lower shafts, thereby insuring positive retention of the shafts in assembled relation. However, this arrangement required assembly of the upper and lower shafts prior to insertion thereof into the lower unit. It also required disassembly of the lower unit to enable removal of the drive shaft assembly from the lower unit so as thereafter to enable disassembly of the drive shaft assembly for the purpose of replacing one of the upper and lower shafts.

Another arrangement used in the past employs a spring clip as disclosed in U.S. Pat. No. 5,112,259. This arrangement permits assembly of the upper shaft and the lower shaft after previous positioning of the lower shaft in the lower unit. However, disassembly of the upper and lower shafts still required prior disassembly of the lower unit so as to permit disassembly of the drive shaft assembly.

Attention is directed to the following U.S. Pat. Nos.:

| | | |
|---|---|---|
| 4,493,662 | Taguchi | January 15, 1985 |
| 4,832,637 | Goluba | May 23, 1989 |
| 4,869,121 | Meisenburg | September 26, 1989 |
| 5,112,259 | McElroy, Jr. et al. | May 12, 1992 |

SUMMARY OF THE INVENTION

The invention provides an outboard motor comprising a propulsion unit including a power head including an engine having a crankshaft, and a lower unit including a drive shaft housing and a gear case including a propeller shaft, a propeller on the propeller shaft, and a reversing transmission connected to the propeller shaft, and a drive shaft assembly having a vertically extending axis and comprising a lower shaft drivingly connected to the transmission and having an upper end portion including an upper end, and an axial bore extending downwardly from the upper end, an upper shaft drivingly connected to the crankshaft and including a lower end portion received in the axial bore and including a lower end and an outer surface extending axially from the lower end, means on the outer end portions of the upper and lower shafts for preventing rotary movement therebetween, and means for selectively permitting assembly and disassembly of the upper and lower shafts and for preventing disassembly of the upper and lower shafts comprising an annular groove in the axial bore in the lower shaft, an inclined bore located in the end portion of the upper shaft, extending upwardly at an acute angle to the axis, and having an opening located wholly in the outer surface, and a ball movable in the inclined bore and in the annular groove between a locked position wherein, when the axis is vertical, the ball is partially located in the annular groove and partially located in the inclined bore, thereby preventing disassembly of the shafts, and an unlocked position wherein the ball is wholly located in the inclined bore, thereby permitting assembly and disassembly of the shafts by permitting insertion and withdrawal of the end portion of the upper shaft relative to the axial bore of the lower shaft.

The invention also provides a shaft assembly including a vertically extending axis and comprising a lower shaft having an upper end portion including an upper end, and an axial bore extending downwardly from the upper end, an upper shaft including a lower end portion received in the axial bore and including a lower end and an outer surface extending axially from the lower end, means on the outer end portions of the upper and lower shafts for preventing rotary movement therebetween, and means for selectively permitting assembly and disassembly of the upper and lower shafts and for preventing disassembly of the upper and lower shafts comprising an annular groove in the axial bore in the lower shaft, an inclined bore located in the end portion of the upper shaft, extending upwardly at an acute angle to the axis, and having an opening located wholly in the outer surface, and a ball movable in the inclined bore and in the annular groove between a locked position wherein, when the axis is vertical, the ball is partially located in the annular groove and partially located in the inclined bore, thereby preventing disassembly of the shafts, and an unlocked position wherein the ball is wholly located in the inclined bore, thereby permitting assembly and disassembly of the shafts by permitting insertion and withdrawal of the end portion of the upper shaft relative to the axial bore of the lower shaft.

The invention also provies a shaft assembly having an axis and comprising a lower shaft including, a main portion, and an upper end portion extending from the main portion and including an upper end, and an axial bore extending downwardly from the upper end and including therein a female splined sub-portion located adjacent the end, and an annular groove located inwardly of the female splined sub-portion, an upper shaft including a main portion, and a lower end portion extending from the main portion of the upper shaft, received in the axial bore, and including a male splined sub-portion located adjacent the main portion of the lower shaft, received in the female splined sub-portion, and a terminal sub-portion extending from the male splined sub-portion, located remotely from the main portion, and including a lower end surface, an axially extending outside surface, and an inclined bore extending upwardly at an acute angle to the axis and having an opening located wholly in the outside surface, and a ball movable in the inclined bore and in the annular groove between a locked position wherein, when the axis is vertical, the ball is partially located in the annular groove and partially located in the inclined bore, thereby preventing disassembly of the shafts, and a unlocked position wherein the ball is wholly located in the inclined bore, thereby permitting disassembly of the shafts by permitting withdrawal of the end portion of the upper shaft from the axial bore of the lower shaft.

Other features of and advantages of the invention will become apparent to those skilled in the art upon review of the following detailed description, claims, and drawings.

Figure 1:
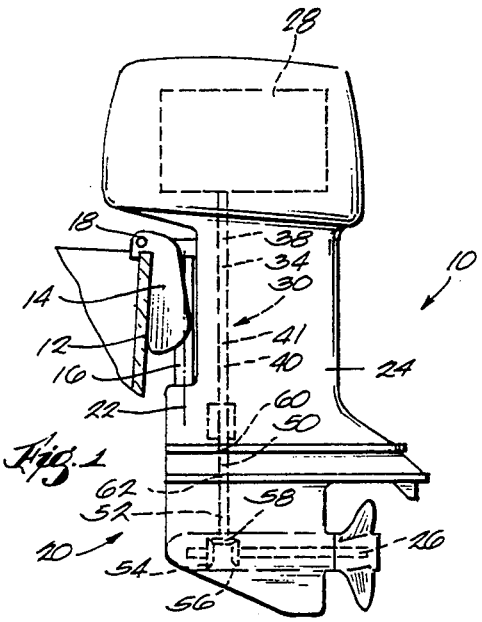
FIG. 1 is a side elevational view of an outboard motor embodying various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Shown in FIG. 1 is a marine propulsion device 10 embodying the invention. Although the invention is illustrated and described herein in conjunction with an outboard motor, the invention can be used in conjunction with stern drives and other types of marine propulsion devices. As best shown in FIG. 1, the marine propulsion device 10 comprises a mounting assembly fixedly attached to a boat transom 12. While various suitable mounting assemblies can be employed, in the preferred embodiment, the mounting assembly includes a transom bracket 14 fixedly attached to the transom 12, and a swivel bracket 16 mounted on the transom bracket 14 for pivotal movement of the swivel bracket 16 relative to the transom bracket 14 about a generally horizontal tilt axis 18.

The marine propulsion device 10 further comprises a propulsion unit 20 mounted on the swivel bracket 16 for tilting movement relative to the transom bracket 14 in common with the swivel bracket 16 and for pivotal movement of the propulsion unit 20 relative to the swivel bracket 16 about a generally vertical steering axis 22. The propulsion unit 20 includes a lower unit 24 having a rotatably mounted propeller shaft 26, and further includes an internal combustion engine 28 mounted on the lower unit 24. The marine propulsion device 10 further includes a drive shaft assembly 30 which is rotatably mounted in the lower unit 24 of the propulsion unit 20 and which drivingly connects the engine 28 to the propeller shaft 26.

The drive shaft assembly 30 has a generally vertical axis 36 and a first or upper drive shaft 34 including a first or upper end portion 38 connected to and drivingly engaged by the engine 28. The first or upper drive shaft 34 further includes a second or lower end portion 40 opposite the upper end portion 38, and a main portion 41 intermediate the upper and lower end portions 38 and 40. A keyway 42 is formed on the main portion 41 adjacent to the lower end portion 40 for a purpose that will later be described.

The drive shaft assembly 30 further includes a second or lower drive shaft 50 aligned with the first drive shaft 34 along the axis 36 and having a first or lower end portion 52 connected to the propeller shaft 26. More particularly, the lower unit 24 includes a transmission 54 in driving engagement with the propeller shaft 26 and including a bevel gear 56, and the lower end portion 52 of the lower drive shaft 50 includes a bevel gear 58 drivingly engaged with the bevel gear 56 of the transmission 54. The second or lower drive shaft 50 further includes a second or upper end portion 60 opposite the first or lower end portion 52, and a main portion 62 intermediate the lower end and upper end portions 52 and 60.

The marine propulsion device 10 further includes means for preventing relative rotation between the upper and lower drive shafts 34 and 50, respectively, and for rotatably driving the lower drive shaft 50 from the upper drive shaft 34. While various other means could be employed, in the illustrated embodiments, the driving and relative rotation preventing means comprises a male spline or splined sub-portion 64 on the lower end portion 40 of the upper drive shaft 34 and an axial bore 66 extending downwardly in the upper end portion 60 of the lower drive shaft 50, which axial bore 66 is provided, adjacent the upper end thereof, with a female spline or splined sub-portion 68 receiving the male spline 64 in direct driving engagement in alignment with the axis 36.

The main propulsion device 10 further includes means for selectively permitting assembly and disassembly of the upper and lower drive shafts 34 and 50 and for preventing disassembly of the upper and lower drive shafts 34 and 50 in the direction of the axis 36. While other constructions can be employed, in the disclosed construction, such means comprises a terminal or end sub-portion 70 which extends from the male splined sub-portion 64, which has a lower outer end 72, an outer cylindrical surface 74, extending upwardly from the outer end 72, and an inclined bore 76 which extends inwardly and upwardly at an acute angle to the axis 36 and which includes an upper blind end 78, and a lower open end 80 wholly located in the outer cylindrical surface 74 of the terminal sub-portion 70 and located below the blind upper end 78.

The means for selectively permitting and preventing assembly and disassembly of the upper and lower shafts 34 and 50 also includes, in the axial bore 66 in said lower shaft 50, an annular groove 82 located below the female splined sub-portion 68 and having an axial height 84 and radial depth 86 as will be referred to hereinafter. In the past, an axial groove has been provided below the female splined sub-portion 68 for the purposes of chip relief, when forming the female splined sub-portion 68.

The means for selectively permitting and preventing assembly and disassembly of said upper and lower shafts 34 and 50 also includes a locking member in the form of a hardened steel ball 90 having a diameter slightly smaller than the diameter of the angled bore 76 and slightly less than the axial height 84 of the annular groove 82. In other words, the annular groove 82 has an axial height 84 slightly greater than the ball 90. In addition, the radial depth 86 of the annular groove 82 is about one-half the diameter of the ball 90.

Figure 2:
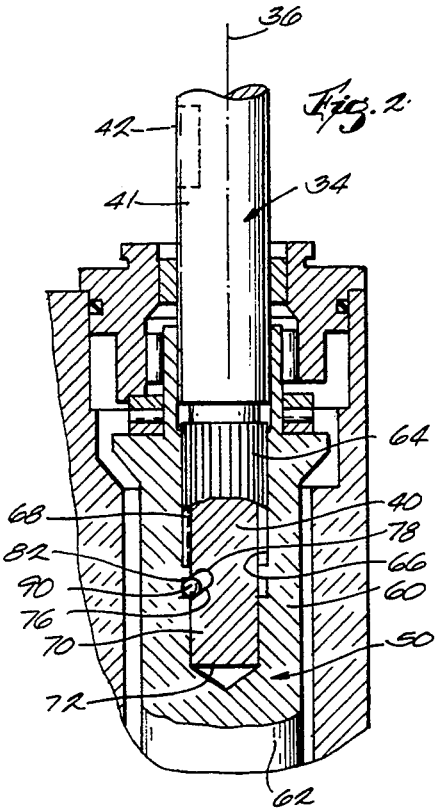
FIG. 2 is an enlarged fragmentary view, in section, of certain of the components which are included in the outboard motor shown in FIG. 1 and which are shown in vertical locked disposition.
Figure 5:
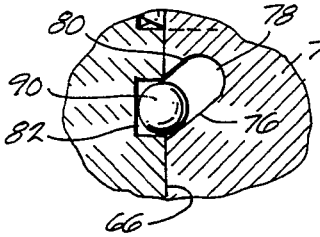
FIG. 5 is an enlarged fragmentary view, in section, of the arrangement for releasably coupling the upper and lower drive shafts.
Figure 4:
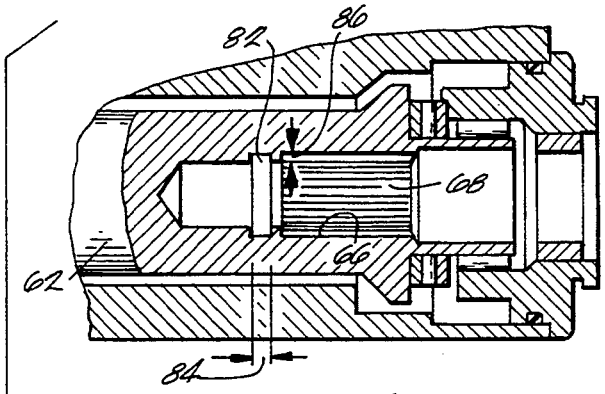
FIG. 4 is a view similar to FIG. 3 with the components shown with one of the shafts withdrawn from the other shaft.
Figure 4:
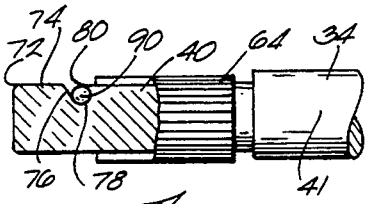
Figure 3:
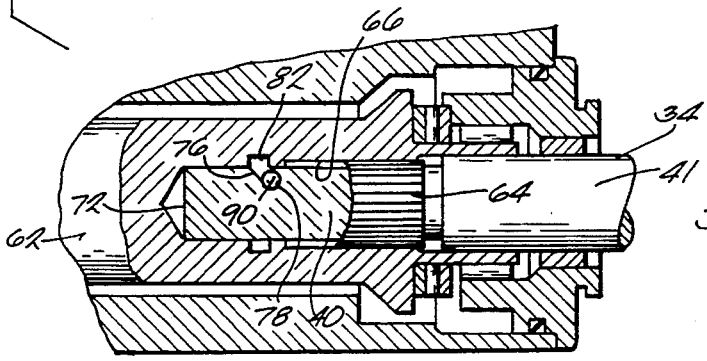
FIG. 3 is a view similar to FIG. 2 except that the components are shown in horizontal unlocked disposition.

As a consequence, when the drive shaft assembly 30 is in the vertical position as shown in FIGS. 1, 2, and 5, the ball 90 moves, by gravity, to a lower locked position wherein said ball 90 is partially located in said annular groove 82 and partially in the inclined bore 76, thereby preventing disassembly of the upper and lower shafts 34 and 50.

When the lower unit 24 is laid on the side thereof in a horizontal position, or when the drive shaft assembly 30 has been removed from the lower unit 24 and is displaced to a horizontal disposition, with the opening of the inclined bore 76 facing upwardly, the ball 90 moves totally into the inclined bore 76 and out of the annular groove 82, thereby permitting disassembly and reassembly of the shafts 34 and 50 by permitting withdrawal and insertion of the lower end portion 40 of the upper shaft 34 from the axial bore 66 of the lower shaft 50.

More particularly, to assemble the upper shaft 34 to the lower shaft 50, the ball 90 is placed in the inclined bore 76 in the upper shaft 34 and the lower end portion 40 of the upper shaft 34, including the ball 90, are inserted into the axial bore 66 in the lower shaft 50. When the assembled outboard motor is in its normal operating position, the drive shaft assembly 30 extends vertically, and gravity causes the ball 90 to roll downwardly in the inclined bore 76 and into engagement at least partially in the annular groove 82. With the proper angle between the inclined bore 76 and the axis 36, any upward force on the upper shaft 34 will wedge the ball 90 between the annular groove 82 and the inclined bore 76, thereby preventing disassembly of the drive shaft assembly 30.

The proper angle mentioned above depends of the radial depth 86 of the annular groove 82, i.e., the distance between the outside diameter of the annular groove 82 and the minor diameter of the female splined sub-portion 68. The larger this distance, the steeper the angle can be, although this distance preferably is not greater than half the diameter of the ball 90.

As indicated, to remove the upper shaft 34 from the lower shaft 50, the lower unit assembly 24, after removal from the engine 28, is tilted to an angle that allows the ball 90 to roll by gravity to the blind end 78 of the inclined bore 76, thereby disengaging the ball 90 from the annular groove 82. Any outward force along the axis 36 will then cause the upper shaft 34 to be removed and disassembled from the lower shaft 50. To enable a person performing such disassembly to know when the inclined bore 76 is positioned to facilitate movement of the ball 90 to the unlocked position adjacent the blind end 78, i.e., when the blind end 78 of the inclined bore 76 is vertically below the location of the ball 90 in the annular groove 82, the upper drive shaft 34 can be provided with an identifying feature aligned with the inclined bore 76, such as the before mentioned keyway 42 which is axially aligned with the opening 80 of the inclined bore 76. In actual practice, disassembly can be accomplished by laying the lower unit 24 on its side on a workbench, by rotating the upper shaft 34 until the keyway 42 is facing upwardly (which indicates that the opening 80 of the inclined bore 76 is also facing upwardly), and by then axially withdrawing the upper shaft 34 out of the lower shaft 50. Alternatively, turning the drive shaft assembly totally upside-down would allow the upper shaft 34 to disengage from the lower shaft 50 regardless of the orientation of the keyway 42. Thus, the shaft assembly 30 can be disposed in various positions, including a vertically inverted position, to enable movement of the ball 90 by gravity into the unlocked position wholly within the inclined bore 76.

The construction disclosed herein advantageously permits the upper and lower shafts to be connected and disconnected when the lower unit is fully assembled, which assembly and disassembly has not been possible in the past. In addition, the disclosed construction is less expensive than the arrangements used in the past.

Various features of the invention are set forth in the following claims.

I claim:

1. An outboard motor comprising a propulsion unit including a power head including an engine having a crankshaft, and a lower unit including a drive shaft housing and a gear case including a propeller shaft, a propeller on said propeller shaft, and a reversing transmission connected to said propeller shaft, and a drive shaft assembly having a vertically extending axis and comprising a lower shaft drivingly connected to said transmission and having an upper end portion including an upper end, and an axial bore extending downwardly from said upper end, an upper shaft drivingly connected to said crankshaft and including a lower end portion received in said axial bore and including a lower end and an outer surface extending axially from said lower end, means on said outer end portions of said upper and lower shafts for preventing rotary movement therebetween, and means for selectively permitting assembly and disassembly of said upper and lower shafts and for preventing disassembly of said upper and lower shafts comprising an annular groove in said axial bore in said lower shaft, an inclined bore located in said end portion of said upper shaft, extending upwardly at an acute angle to said axis, and having an opening located wholly in said outer surface, and a ball movable in said inclined bore and in said annular groove between a locked position wherein, when said axis is vertical, said ball is partially located in said annular groove and partially located in said inclined bore, thereby preventing disassembly of said shafts, and an unlocked position wherein said ball is wholly located in said inclined bore, thereby permitting assembly and disassembly of said shafts by permitting insertion and withdrawal of said end portion of said upper shaft relative to said axial bore of said lower shaft.

2. A shaft assembly including a vertically extending axis and comprising a lower shaft having an upper end portion including an upper end, and an axial bore extending downwardly from said upper end, an upper shaft including a lower end portion received in said axial bore and including a lower end and an outer surface extending axially from said lower end, means on said outer end portions of said upper and lower shafts for preventing rotary movement therebetween, and means for selectively permitting assembly and disassembly of said upper and lower shafts and for preventing disassembly of said upper and lower shafts comprising an annular groove in said axial bore in said lower shaft, an inclined bore located in said end portion of said upper shaft, extending upwardly at an acute angle to said axis, and having an opening located wholly in said outer surface, and a ball movable in said inclined bore and in said annular groove between a locked position wherein, when said axis is vertical, said ball is partially located in said annular groove and partially located in said inclined bore, thereby preventing disassembly of said shafts, and an unlocked position wherein said ball is wholly located in said inclined bore, thereby permitting assembly and disassembly of said shafts by permitting insertion and withdrawal of said end portion of said upper shaft relative to said axial bore of said lower shaft.

3. A shaft assembly having an axis and comprising a lower shaft including a main portion, and an upper end portion extending from said main portion and including an upper end, and an axial bore extending downwardly from said upper end and including therein a female splined sub-portion located adjacent said end, and an annular groove located inwardly of said female splined sub-portion, an upper shaft including a main portion, and a lower end portion extending from said main portion of said upper shaft, received in said axial bore, and including a male splined sub-portion located adjacent said main portion of said lower shaft, received in said female splined sub-portion, and a terminal sub-portion extending from said male splined sub-portion, located remotely from said main portion, and including a lower end surface, an axially extending outside surface, and an inclined bore extending upwardly at an acute angle to said axis and having an opening located wholly in said outside surface, and a ball movable in said inclined bore and in said annular groove between a locked position wherein, when said axis is vertical, said ball is partially located in said annular groove and partially located in said inclined bore, thereby preventing disassembly of said shafts, and an unlocked position wherein said ball is wholly located in said inclined bore, thereby permitting disassembly of said shafts by permitting withdrawal of said end portion of said upper shaft from said axial bore of said lower shaft.

* * * * *

UNITED STATES PATENT AND TRADEMARK OFFICE

CERTIFICATE OF CORRECTION

PATENT NO. : 5,411,423

DATED : May 2, 1995

INVENTOR(S) : Jeffrey P. Higby

It is certified that error appears in the above—identified patent and that said Letters Patent is hereby corrected as shown below: Item [73], On the cover page, please add the following:

Assignee: Outboard Marine Corporation
Waukegan, Illinois

Signed and Sealed this

Second Day of July, 1996

Bruce Lehman

*Attest:*

BRUCE LEHMAN

*Attesting Officer*

*Commissioner of Patents and Trademarks*